US006200177B1

(12) United States Patent
Scott et al.

(10) Patent No.: US 6,200,177 B1
(45) Date of Patent: Mar. 13, 2001

(54) MULTI-SPEED MARINE PROPULSION SYSTEM WITH IMPROVED AUTOMATIC SHIFTING STRATEGY BASED SOLEY ON ENGINE SPEED

(75) Inventors: Philip Scott, Anderson, SC (US); William C. Stephenson, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/495,196

(22) Filed: Jan. 31, 2000

(51) Int. Cl.[7] ..... B63H 20/14
(52) U.S. Cl. ..... 440/75; 440/86
(58) Field of Search ..... 440/75, 84, 86, 440/87, 88

(56) References Cited

U.S. PATENT DOCUMENTS 4,173,939 * 11/1979 Strang ..... 440/75
4,820,209 4/1989 Newman ..... 440/74
5,018,996 5/1991 Newman et al. ..... 440/75
5,419,412 5/1995 Schwab et al. ..... 180/336
5,711,742 1/1998 Leinoen et al. ..... 477/121
5,738,605 4/1998 Fliearman et al. ..... 477/108

* cited by examiner

*Primary Examiner*—Stephen Avila
(74) *Attorney, Agent, or Firm*—William D. Lanyi

(57) ABSTRACT

A marine propulsion system is provided with a gear shifting apparatus and method that changes a transmission from a low gear to a high gear, and vice versa, based solely on the engine speed. Engine speed is measured and a rate of change of engine speed is determined as a function of the actual change in engine speed over a measured time interval. Several threshold magnitudes are preselected and used to define one or more engine speed ranges. At least one threshold magnitude is used to compare the actual rate of change of engine speed to a preselected value. Both up shifting and down shifting of a transmission are controlled as a function of engine speed and rate of change of engine speed.

19 Claims, 3 Drawing Sheets

MULTI-SPEED MARINE PROPULSION SYSTEM WITH IMPROVED AUTOMATIC SHIFTING STRATEGY BASED SOLEY ON ENGINE SPEED

BACKGROUND OF THE INVENTION

1. Field of the Invention

The present invention is generally related to a marine transmission, or gear shifting mechanism, and more particularly to a two-speed transmission control strategy that selects the appropriate gear ratio based solely on engine speed, as represented by engine crankshaft RPM and the rate of change of the engine crankshaft RPM.

2. Description of the Prior Art

Multi-speed marine propulsion systems have been developed to provide the ability to change the ratio of speed between the crankshaft of an engine and the propeller shaft of a marine vessel. Control strategies for selecting a gear ratio of the transmission have typically been based on several input parameters, such as manifold absolute pressure (MAP), load on the system, throttle position, and speed.

U.S. Pat. No. 5,711,742, which issued to Leinonen et al on Jan. 27, 1998, describes a multi-speed marine propulsion system with automatic shifting mechanism. The system, preferably having dual counterrotating propellers, has an automatic multi-speed shifting mechanism such as a transmission. An electronic controller monitors engine parameters such as engine revolution speed and load, and generates a control signal in response thereto, which is used to control shifting. Engine load is preferably monitored by sensing engine manifold air pressure. The electronic controller preferably has a shift parameter matrix stored within a programmable memory for comparing engine speed and engine load data to generate the control signal. The system can also have a manual override switch to override shifting of the shifting mechanism.

U.S. Pat. No. 4,820,209, which issued to Newman on Apr. 11, 1989, describes a torque converter marine transmission with a variable power output. A fluid coupling is provided in a marine drive between the engine and the propulsion unit. The fluid coupling includes a fluid pump adapted to be driven by the crankshaft of the engine, and a turbine adapted to be driven by the fuel pump. A series of reactor veins is provided in the fluid coupling. The reactor veins are adapted to be driven in a direction opposite the direction of rotation of the fluid pump. The turbine and the reactor veins are connected to shafts which extend from the fluid coupling to a transmission housing. Each shaft is provided with a gear and a brake disc. An output shaft extends from the transmission housing, and includes a pair of freely rotatable gears engageable with the gears on the reactor shaft and the turbine shaft. Clutch mechanisms are provided on the freely rotatable output shaft gears for selectively engaged the reactor shaft gear in the turbine shaft gear to provide rotation of the output shaft in response to rotation of the reactor shaft and turbine shaft gears. A variable force brake is applied to a disc connected to the output shaft to govern the amount of power transferred by the output shaft to the propulsion unit. The variable force brake is selectively actuable to govern the output of the fluid coupling during low speed operation to provide increased boat performance at such speeds.

U.S. Pat. No. 5,018,996, which issued to Newman et al on May 28, 1991, discloses a flow control fluid coupling marine transmission. A fluid coupling transmission is adapted for interposition between the engine and the propulsion unit of a marine drive. The fluid coupling transmission provides variable speed operation in both forward and reverse. A fluid pump is drivingly connected to the engine crankshaft, and is adapted to drive a turbine. A series of variable position vanes are disposed between the fluid pump and turbine at the entrance of fluid into the pump, for controlling the power transfer therebetween by controlling the amount of fluid passing through the pump and acting on the turbine. A ring gear is connected to the turbine, and a sun gear is connected to the output shaft of the transmission. One or more planet gears are provided between the ring gear and the sun gear, and are rotatably mounted to a carrier member, which extends coaxially with respect to the output shaft. An output control mechanism, including a brake band and a plate clutch mechanism, is selectively engagable with the carrier member so as to control the direction of rotation of the transmission output shaft.

U.S. Pat. No. 5,738,605, which issued to Fliearman et al on Apr. 14, 1998, describes an anti-hunt strategy for an automatic transmission. An anti-hunt transmission control strategy for controlling an automatic transmission so as to prevent the occurrence of a shift hunting condition is provided. The control strategy determines a learned vehicle inertia as well as road load torque and expected torque in an upshift gear. A projected post shift acceleration is predicted based on the expected torque, road load torque and inertia of the vehicle. If vehicle speed and throttle position are within an allowable shift zone and if the predicted post shift acceleration exceeds a threshold value, the vehicle automatic transmission is allowed to upshift. Otherwise, should the predicted post shift acceleration not exceed the threshold value, an upshift is prevented.

U.S. Pat. No. 5,419,412, which issued to Schwab et al on May 30, 1995, describes a gear-shift control and gear-range selector for a semi automatic or fully automatic motion vehicle gearbox. In a motor vehicle having a transmission which can be optionally operated fully automatically or semi-automatically, and in which a gear-range selector and a gear-shift control are provided, the gear-shift control is applicable. The gear-range selector makes it possible to preselect a travel speed in which the transmission is gradually shifted up or down by actuating the gear-shift control. The gear-shift control is designed as a foot switch located in the foot area of a driver's cab of a motor vehicle, so that both of the driver's hand can stay on the steering wheel while these gear-shift operations are being carried out thereby permitting the driver to concentrate fully on the traffic.

The above described United States patents are hereby explicitly incorporated by reference in the description of the present invention.

It would be significantly beneficial if a simplified gear shifting algorithm, or strategy could be provided in which shifting from one gear ratio to another gear ratio is determined solely as a function of the operating speed of an engine, as represented by the crankshaft rotational speed, in RPM, and the rate of change of the crankshaft rotation speed in RPM per second squared.

SUMMARY OF THE INVENTION

A marine propulsion system made in accordance with the present invention comprises an engine having a crankshaft, a propeller shaft, and a propeller attached to the propeller shaft. A gear shifting mechanism is connected in torque transmitting association to the crankshaft and to the propeller shaft and has at least a low gear and a high gear. The low gear provides a greater gear reduction between the crankshaft speed and the propeller shaft speed than the high gear.

The present invention further comprises an engine speed sensor which provides a speed signal that is representative of a rotational speed of the crankshaft. The engine speed sensor can be a tachometer or any other sensor that is capable of providing a signal that is representative of the crankshaft speed. This representative signal can be determined by measuring the speed of any rotating shaft of the marine propulsion system that allows the engine speed to be determined or that represents a multiple of the engine crankshaft speed.

The present invention also comprises a timer that provides a time signal which is representative of elapsed time. The timer can provide periodic signals which represent elapsing time and which allow the controller to calculate the elapsed time between sequential signals. Alternatively, the timer can provide a signal at a fixed predetermined interval. The controller of the present invention is connected to the engine speed sensor to receive the speed and time signals. The controller provides an output signal to the shifting mechanism in order to control the shifting mechanism as a function of the engine speed and the rate of change of the engine speed. The propeller shaft can be supported in a stern drive housing and the gear shifting mechanism can be a two speed transmission.

In operation, the present invention performs the method for controlling a gear shifting mechanism of a marine propulsion system that comprises the steps of measuring an instantaneous rotational speed of a motive shaft, providing a multi-speed transmission connected to the motive shaft and to a propeller shaft that is attached to a marine propeller, measuring a change in the instantaneous rotational speed of the motive shaft over a time interval, determining a rate of change of the instantaneous rotational speed of the motive shaft, selecting a chosen operating gear ratio for the multi-speed transmission as a function of the rate of change of the instantaneous rotational speed of the motive shaft, and shifting the multi-speed transmission into the chosen operating gear ratio.

The present invention further comprises selecting the chosen operating gear ratio for the multi-speed transmission as a function of both the instantaneous rotational speed of the motive shaft and the rate of change of the instantaneous rotational speed of the motive shaft.

The determining step of the present invention can comprise the step of dividing the change in instantaneous rotational speed by the time interval.

The motive shaft can be a crankshaft of an engine and the time interval can be constant for sequential iterations of the measuring steps. A constant time interval can be predetermined prior to performing the steps of the controlling method.

The present invention can further comprise the step of selecting the chosen operating gear ratio for the multi-speed transmission to be a high gear if the multi-speed transmission is presently in a low gear (i.e. high speed reduction) and the instantaneous rotational speed is greater than a first preselected magnitude, and the instantaneous rotational speed is less than a second preselected magnitude, and the rate of change of the instantaneous rotational speed is less than a third preselected magnitude.

In a particularly preferred embodiment of the present invention, the first preselected magnitude, the second preselected magnitude, and the third preselected magnitude are 3300 RPM, 3830 RPM, and 1.43 revolutions per second squared, respectively. Alternatively, these three parameters can be 3830 RPM, 4360 RPM, and 1.66 revolutions per second squared, respectively. These parameters can also alternatively be 4360 RPM, 4800 RPM, and 2.00 revolutions per second squared, respectively.

To perform the method of the present invention, a marine propulsion system comprises a means for measuring the instantaneous rotational speed of a motive shaft, a means for providing a multi-speed transmission connected to the motive shaft and to a propeller shaft that is attached to a marine propeller, means for measuring a change in the instantaneous rotational speed of the motive shaft over a time interval, means for determining a rate of change of the instantaneous rotational speed of the motive shaft, means for selecting a chosen operating gear ratio for the multi-speed transmission as a function of the rate of change of the instantaneous rotational speed, and means for shifting the multi-speed transmission into the chosen operating gear ratio. The measuring means can be a tachometer, the multi-speed transmission can be connected in torque transmitting association between the motive shaft and the propeller shaft, and the change measuring means can comprise a timer and a tachometer. Furthermore, the multi-speed transmission can be a two speed transmission and the marine propulsion system can be a stern drive unit.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
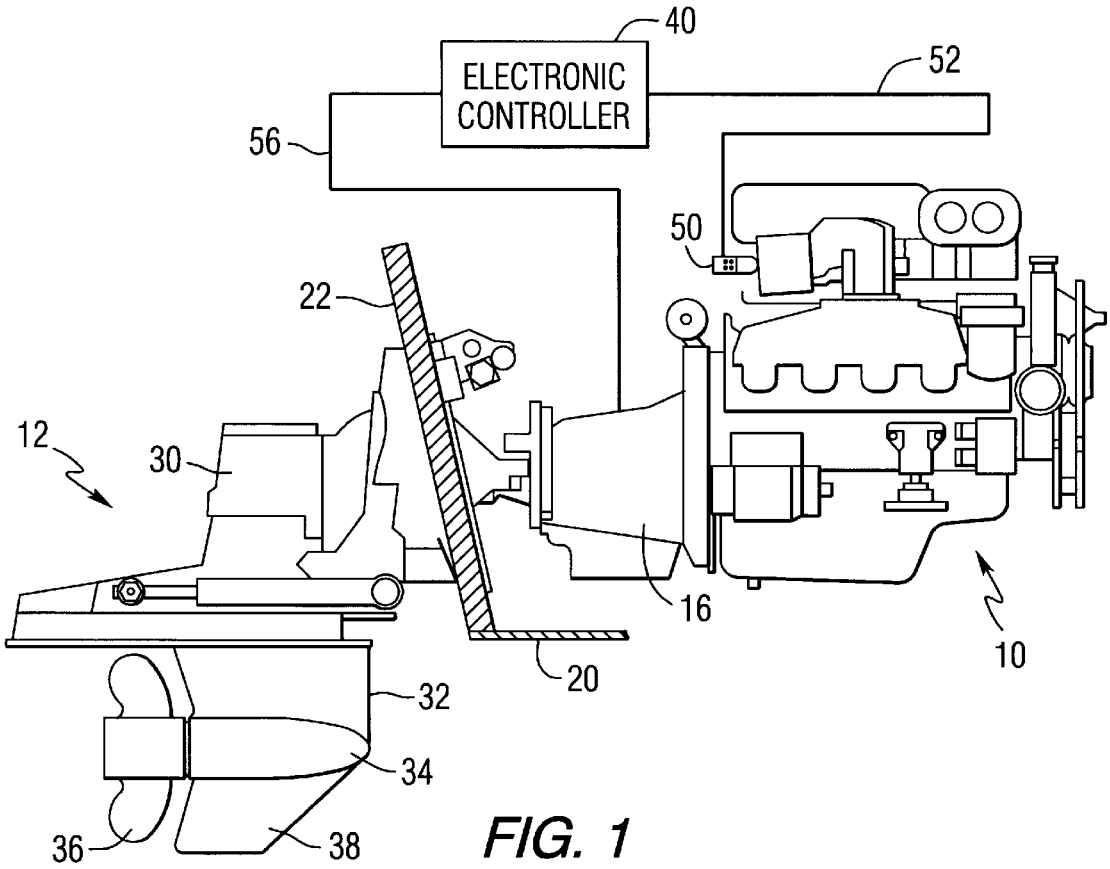
FIG. 1 shows a marine propulsion system.

Throughout the description of the preferred embodiment, like components will be identified by like reference numerals.

FIG. 1 shows an exemplary stem drive marine propulsion system which comprises an engine 10, a stem drive unit 12 and a transmission 16 disposed between the engine 10 and the stem drive unit 12. The bottom 20 and transom 22 of a boat are shown in section view for perspective purposes.

The stern drive unit 12 has an upper housing 30, a lower housing 32, and a gearcase 34 that supports a propeller shaft. A propeller 36 is attached to the propeller shaft (not shown in FIG. 1). A skeg 38 is formed as a lower portion of the stern drive unit 12.

An electronic controller 40, or electronic control unit (ECU), is provided to receive signals from various sensors associated with the engine 10 and provide various control signals to components of the engine 10. For example, an engine control unit (ECU) provides signals to a throttle control, fuel injectors, and fuel pumps, and receives signals from various pressure sensors, temperature sensors, and other transducers that provide information relating to the operating condition of the engine 10. In FIG. 1, a tachometer 50 is shown connected to a signal line 52 which provides speed related information to the electronic controller 40, or engine control unit. An output signal line 56 is connected to both the electronic controller 40 and the transmission 16. This line 56 allows the electronic controller 40 to provide output signals to a transducer that activates a gear ratio change within the transmission 16. Although not illustrated in FIG. 1, it should be understood that the specific transducer used to implement the gear ratio change within the transmission 16 can be a solenoid, a motor, a hydraulic cylinder, or any other component that is able to effect a gear ratio change within the transmission 16.

With continued reference to FIG. 1, a particularly preferred embodiment of the present invention utilizes only the information obtained from the tachometer 50, in conjunction with an internal timer within the electronic controller 40, to determine the appropriate time to make a gear ratio change within the transmission 16. Although prior art transmissions control algorithms, such as than described in detail in U.S. Pat. No. 5,711,742, utilize additional information, such as manifold absolute pressure or engine load, the present invention depends solely on engine speed information, such as crankshaft speed and the rate of change of crankshaft speed, to decide the appropriate time to switch gears within the transmission 16 from a low gear to a high gear or from a high gear to a low gear.

Figure 2:
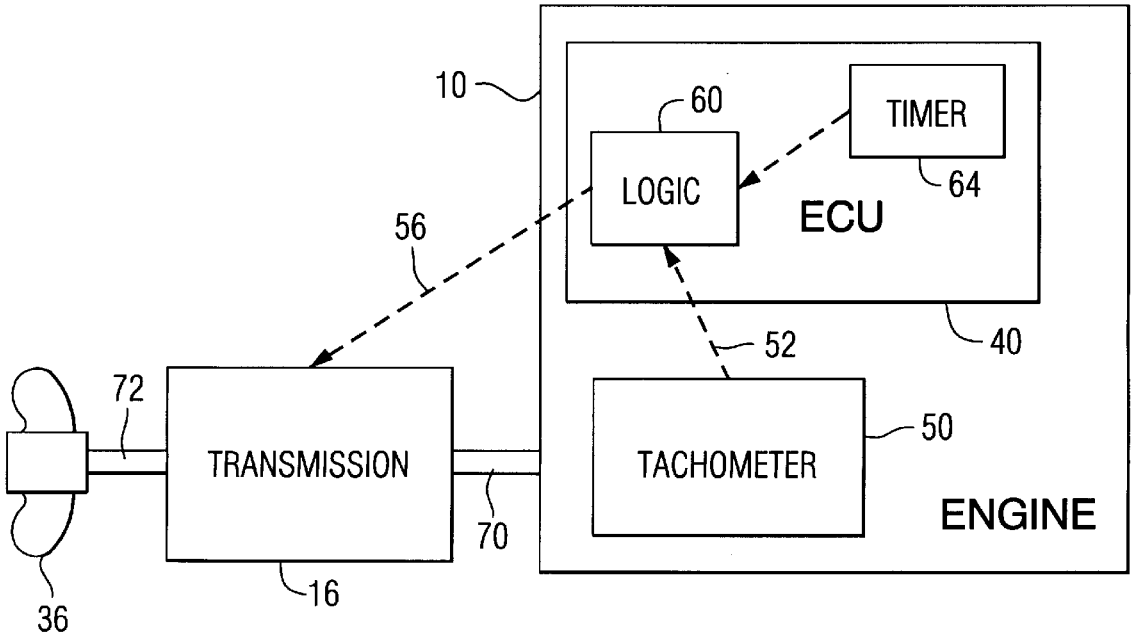
FIG. 2 is a highly schematic representation of a control system for a transmission of a marine propulsion system.

FIG. 2 is a highly schematic representation of the electronic controller 40, or engine control unit, in relation to the transmission 16 and the propeller 36. Associated with the engine 10, is the tachometer 50 which provides a signal 52 to the logic unit 60 of the engine control unit. An internal timer 64 provides timing signals to the logic portion of the ECU. With the information provided by the tachometer 50 and the timer 64, the logic portion 60 of the engine control unit is able to determine the appropriate time to cause a gear ratio change within the transmission 16 by providing a signal on line 56, as described above in conjunction with FIG. 1.

Also shown in FIG. 2 is a crankshaft 70 and the propeller shaft 72. The engine speed can be provided by a tachometer associated with the engine 10 in such a way that the crankshaft 70 speed is determinable. As is well known to those skilled in the art, a tachometer can operate in conjunction with the electrical distribution system of the engine 10. Alternatively, additional signal providing gears can be associated with the cam shaft or crankshaft of the engine 10 for these purposes. The specific speed sensing means is not limiting to the present invention and can be a tachometer 50 or, alternatively, a Hall effect gear tooth sensor associated with a gear connected to one of the rotating shafts of the engine, or any type of resolver that is able to provide a signal to the engine control unit 40 that represents a speed of the engine 10.

Throughout the description of the preferred embodiment of the present invention, the gear ratio of the transmission 16 refers to the ratio in speed between the crankshaft 70 and the propeller shaft 72. In many types of marine propulsion systems, the transmission 16 is not connected directly to both the propeller shaft 72 and the crankshaft 70 but, instead, the propeller shaft 72 is associated with additional gearing and shafts. For purposes of this description, the more simplified schematic representation in FIG. 2 is sufficient to describe the operation of the present invention.

Figure 3:
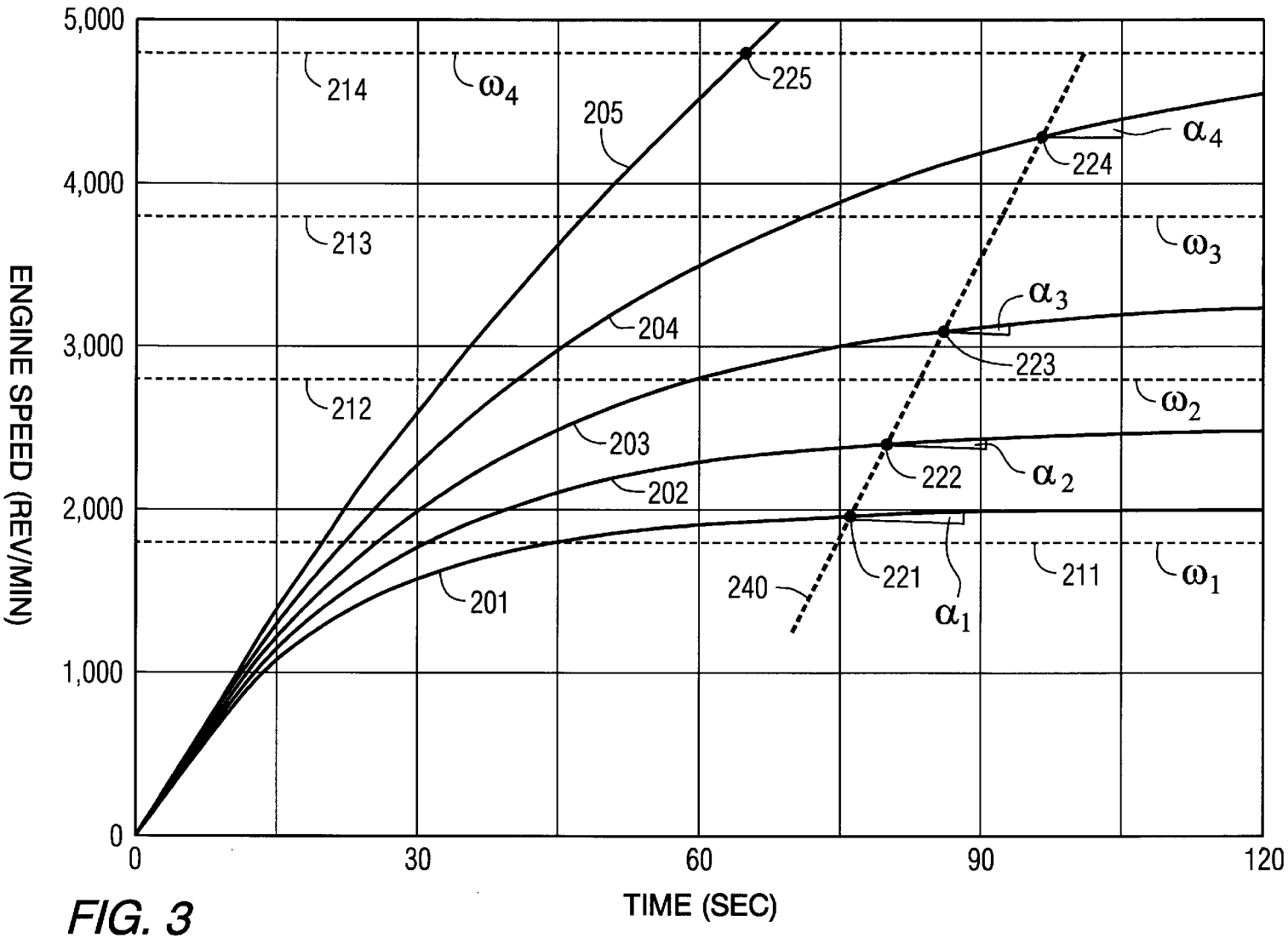
FIG. 3 shows several possible acceleration curves.

FIG. 3 shows five acceleration curves, 201–205, which represent different rates of change (e.g. $\alpha_1$–$\alpha_4$) in engine speed as a function of time. The five acceleration curves show how the present invention would operate to shift from low gear to high gear under several different circumstances. Lines 211, 212, 213, and 214 represent four exemplary engine speeds (i.e. $\omega_1$–$\omega_4$) that can be used, in the manner described above, to determine the shift points according to the operation of the present invention. For example, if the engine speed is between lines 211 and 212 and the acceleration is less than a predetermined limit (e.g. $\alpha_1$ or $\alpha_2$), the present invention would cause the transmission to shift from low speed to high speed. This shift point could occur at point 221 or 222 since both of these shift points result from the interrogation, by the present invention, of the engine speed (i.e. between $\omega_1$–$\omega_2$) and acceleration (i.e. less than $\alpha_1$ and $\alpha_2$, where $\alpha_1$=$\alpha_2$) described above. Both shift points, 221 and 222, result from the fact that the engine speed is between lines 211 and 212 (i.e. between $\omega_1$–$\omega_2$) and the acceleration is less than the predetermined limit (i.e. $\alpha_1$–$\alpha_2$). Similarly, with reference to acceleration curve 203, shift point 223 would occur because the engine speed is between lines 212 and 213 (i.e. between $\omega_2$–$\omega_3$) and the acceleration is less than a predetermined limit $\alpha_3$. It should be understood that the predetermined acceleration limit $\alpha_3$ which causes the shift to occur at point 223 is greater than the predetermined acceleration limit, $\alpha_1$–$\alpha_2$, which causes the shift to occur at points 221 and 222. This results from the fact that point 223 is between lines 212 and 213 while points 221 and 222 are between lines 211 and 212.

With continued reference to FIG. 3, shift point 224 occurs because the engine speed is between lines 213 and 214 (i.e. $\omega_3$–$\omega_4$) and the acceleration is less than a predetermined limit $\alpha_4$ associated with the range of speeds between these two limits. As can be seen, dashed line 240 connects shift points 221–224. With reference to acceleration curve 205, the present invention would cause the transmission to shift from low gear to high gear when the engine speed exceeds line 214 (i.e. $\omega_4$), as represented by shift point 225.

In the above description of the preferred embodiment, engine speed threshold magnitudes $\omega_1$–$\omega_4$ are used to define three engine speed ranges. For each of these engine speed ranges, an acceleration threshold magnitude, $\alpha_1$–$\alpha_3$, is provided. In one empirically determined embodiment of the present invention, the first threshold magnitude for acceleration $\alpha_1$, is 1.43 revolutions per second squared. The empirical value for the second threshold magnitude $\alpha_2$ is 1.66 revolutions per second squared, and the third threshold magnitude $\alpha_3$ is 2.00 revolutions per second squared.

Figure 4:
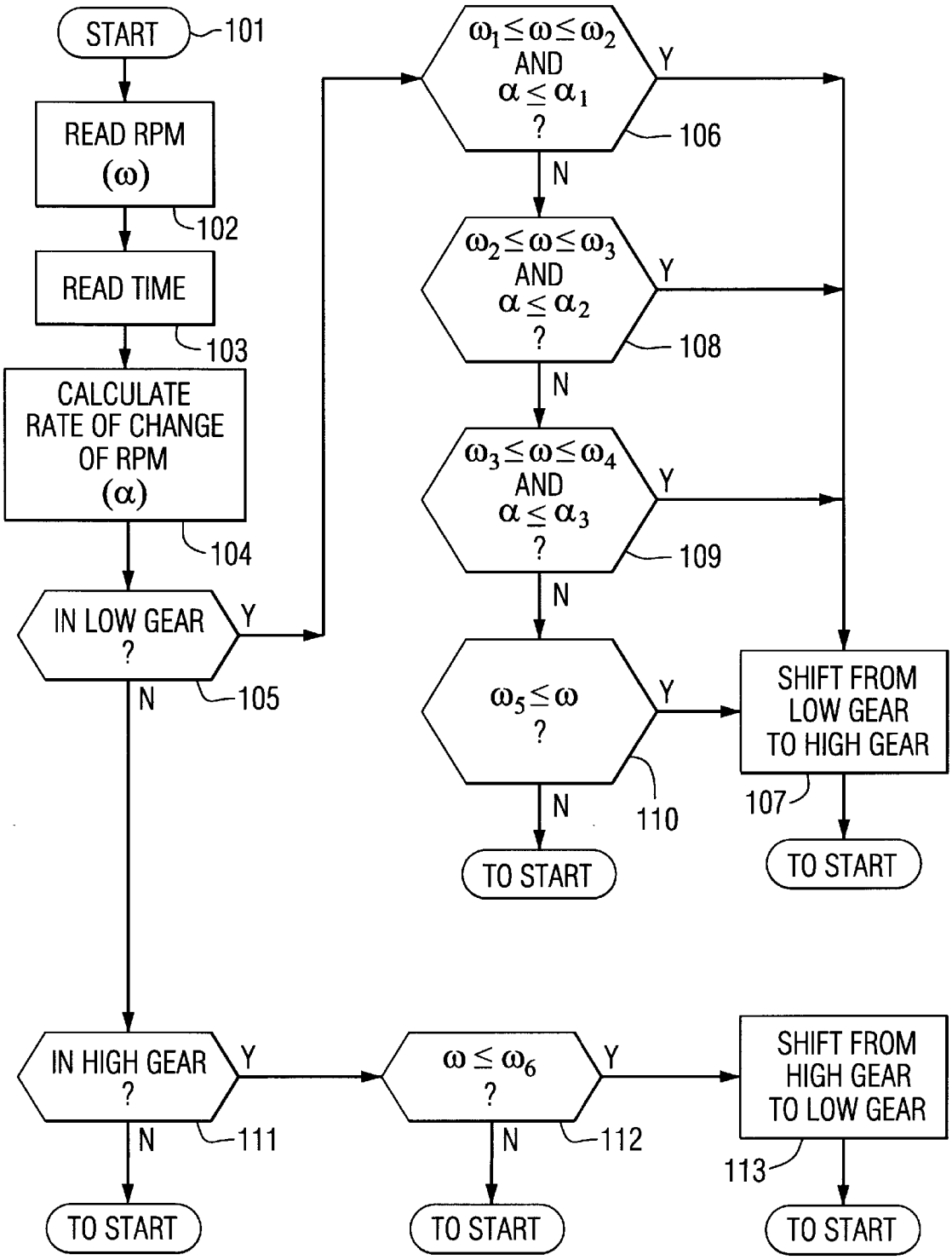
FIG. 4 is a flow chart that implements the basic concept of the present invention.

FIG. 4 shows an exemplary flowchart of the operations performed by the logic portion 60 of the engine control unit 40. When started, at functional block 101, the engine control unit 40 first reads the RPM from a tachometer 50 as represented by functional block 102. Then the engine control unit 40 reads a signal representative of time or of a time interval since the previous RPM reading. This is represented by functional block 103. At functional block 104, a rate of change of RPM is calculated. It should be understood that various means can be provided to make this calculation. For example, the RPM readings of functional block 102 can be timed precisely at predetermined intervals and the rate of acceleration of engine speed can be determined by subtracting sequential readings. Alternatively, the RPM readings of functional block 102 can be taken at varying time interval and the actual time of sequential readings can be subtracted from each other to determine the precise time interval between readings. The difference in RPM could then be divided by the time interval to determine the actual engine speed acceleration rate $\alpha$. At the completion of functional block 104, the logic portion 60 of the engine control unit 40 knows the engine speed RPM $\omega$ and the rate of change of engine speed RPM $\alpha$.

With continued reference to FIG. 4, the engine control unit 40 determines whether or not the transmission 16 is in a low gear. This is performed at functional block 105. If the transmission is in a low gear, several comparisons are made in series. At functional block 106, the actual RPM $\omega$ is compared to the first and second threshold magnitudes to determine if the engine speed is in the first range defined by $\omega_1$ and $\omega_2$. The rate of change of RPM $\alpha$ is also compared to the first acceleration threshold magnitude $\alpha_1$. If both of these conditions shown in functional block 106 are satisfied, the transmission is shifted from low gear to high gear as represented by functional block 107. If not, the further comparisons represented by functional blocks 108, 109, and 110 are made. If any of the conditions of these functional blocks are satisfied, the transmission 16 is shifted from low gear to high gear as represented by functional block 107. If not, the algorithm returns to the start point 101.

With continued reference to FIG. 4, if the transmission 16 is not in low gear, as tested by functional block 105, functional block 111 determines whether it is in high gear. It should be noted that an alternative approach to the algorithm represented in FIG. 4 would be to assume that the transmission is in high gear if it is not in low gear. This is possible if the transmission is a two-speed transmission. If the interrogation by functional block 111 responds in a negative answer, the software can return to the start point 101 or, alternatively, an alarm condition can be identified. This, of course, will be dependant upon the type of transmission 16 used and the type of signals provided to identify the current position of the transmission 16. It should be clearly understood that the particular sequence represented by functional blocks 105 and 111 in FIG. 4 is not limited to the present invention.

If the transmission 16 is in high gear, the engine speed RPM $\alpha$ is compared to the speed threshold $\omega_6$ to determine whether or not a shift should be made from high gear to low gear. This comparison is made at functional block 112 and the downshift procedure is represented by functional block 113.

With reference to FIG. 4, it should be understood that the illustrated flow chart is a highly simplified version of the algorithm of the present invention and is intended to illustrate the basic concepts of the present invention. As such, the flow chart of FIG. 4 is not intended to be a limiting algorithm, either qualitatively or quantitatively. For example, a different number of threshold magnitudes $\omega_1$–$\omega_6$, could be used in alternative embodiments of the present invention. Similarly, different absolute magnitudes of these engine speed thresholds could be used in place of those described above. Furthermore, different threshold magnitudes can be used for the rate of change of engine speed, $\alpha_1$–$\alpha_3$.

As described above, the basic concept of the present invention is to control the gear shifting of a transmission 16 solely as a function of engine speed and rate of change of engine speed. It eliminates the need to use manifold absolute pressure (MAP), engine load, or throttle position for these purposes. By simplifying the calculations, the speed of this determination is enhanced. It should be understood that a particularly preferred embodiment of the present invention has been described above and illustrated specifically in FIGS. 1–4. Also, it should be understood that alternative embodiments of the present invention are also within its scope.

We claim:

1. A marine propulsion system, comprising:

an engine having a crankshaft;

a propeller shaft;

a propeller attached to said propeller shaft;

a gear shifting mechanism connected in torque transmitting association to said crankshaft and to said propeller shaft and having at least a low gear and a high gear, said low gear providing a greater gear reduction between said crankshaft and said propeller shaft than said high gear;

an engine speed sensor which provides a speed signal which is representative of a rotational speed of said crankshaft;

a timer which provides a time signal representative of elapsed time; and a controller connected to said engine speed sensor and timer to receive said speed and time signals and provide an output signal to said shifting mechanism to control said shifting mechanism as a function of said engine speed and the rate of change of said engine speed.

2. The system of claim 1, wherein:

said propeller shaft is supported in a sterndrive housing.

3. The system of claim 1, wherein:

said gear shifting mechanism is a two speed transmission.

4. A method for controlling a gear shifting mechanism of a marine propulsion system, comprising:

measuring an instantaneous rotational speed of a motive shaft;

providing a multi-speed transmission connected to said motive shaft and to a propeller shaft that is attached to a marine propeller;

measuring a change in said instantaneous rotational speed over a time interval;

determining a rate of change of said instantaneous rotational speed;

selecting a chosen operating gear ratio for said multi-speed transmission as a function of said rate of change of said instantaneous rotational speed; and shifting said multi-speed transmission into said chosen operating gear ratio.

5. The method of claim 4, further comprising:

selecting said chosen operating gear ratio for said multi-speed transmission as a function of both said instantaneous rotational speed and said rate of change of said instantaneous rotational speed.

6. The method of claim 4, wherein:

said determining step comprises the step of dividing said change in instantaneous rotational speed by said time interval.

7. The method of claim 4, wherein:

said motive shaft is a crankshaft of an engine.

8. The method of claim 4, wherein:

said time interval is constant for sequential iterations of said measuring steps.

9. The method of claim 8, wherein:

said constant time interval is predetermined prior to performing said steps of said controlling method.

10. The method of claim 5, further comprising:

selecting said chosen operating gear ratio for said multi-speed transmission to be a high gear if said multi-speed transmission is in a low gear and said instantaneous rotational speed is greater than a first preselected magnitude and said instantaneous rotational speed is less than a second preselected magnitude and said rate of change of said instantaneous rotational speed is less than a third preselected magnitude.

11. The method of claim 10, wherein:

said first preselected magnitude is 3300 RPM, said second preselected magnitude is 3830 RPM, and said third preselected magnitude is 1.43 revolutions per second squared.

12. The method of claim 10, wherein:

said first preselected magnitude is 3830 RPM, said second preselected magnitude is 4360 RPM, and said third preselected magnitude is 1.66 revolutions per second squared.

13. The method of claim 10, wherein:

said first preselected magnitude is 4360 RPM, said second preselected magnitude is 4800 RPM, and said third preselected magnitude is 2.00 revolutions per second squared.

14. A marine propulsion system, comprising:

means for measuring the instantaneous rotational speed of a motive shaft;

means for providing a multi-speed transmission connected to said motive shaft and to a propeller shaft that is attached to a marine propeller;

means for measuring a change in said instantaneous rotational speed over a time interval;

means for determining a rate of change of said instantaneous rotational speed;

means for selecting a chosen operating gear ratio for said multi-speed transmission as a function of said rate of change of said instantaneous rotational speed; and means for shifting said multi-speed transmission into said chosen operating gear ratio.

15. The system of claim 14, wherein:

said measuring means is a tachometer.

16. The system of claim 14, wherein:

said multi-speed transmission is connected in torque transmitting association between said motive shaft and said propeller shaft.

17. The system of claim 14, wherein:

said change measuring means comprises a timer and a tachometer.

18. The system of claim 14, wherein:

said multi-speed transmission is a two speed transmission.

19. The system of claim 14, wherein:

said marine propulsion system is a stern drive unit.

* * * * *